US007158029B1

(12) United States Patent
Martyn

(10) Patent No.: US 7,158,029 B1
(45) Date of Patent: Jan. 2, 2007

(54) ELECTRONIC SECURITY SYSTEM

(76) Inventor: Elva Lee Martyn, 8433 Chestnut Ave., Apt. A, South Gate, CA (US) 90280-2107

( * ) Notice: Subject to any disclaimer, the term of this patent is extended or adjusted under 35 U.S.C. 154(b) by 108 days.

(21) Appl. No.: 10/810,218

(22) Filed: Mar. 26, 2004

(51) Int. Cl.
*G08B 13/08* (2006.01)

(52) U.S. Cl. ..... 340/545.7; 340/541; 340/542; 340/545.1; 340/545.2; 340/5.7; 200/19.35; 200/61.64; 70/57.1; 70/71; 70/DIG. 49

(58) Field of Classification Search ..... 340/545.7, 340/545.6, 545.1, 540, 541, 542, 552, 561, 340/545.2, 5.7, 539.1, 539.11; 70/DIG. 49, 70/57.1, 71; 200/61.64, 61.67, 19.35; 292/2
See application file for complete search history.

(56) References Cited

U.S. PATENT DOCUMENTS

| | | | | |
|---|---|---|---|---|
| 3,890,608 A | | 6/1975 | Peterson | 340/274 |
| 4,804,945 A | | 2/1989 | Millet | 340/541 |
| 5,311,168 A | * | 5/1994 | Pease et al. | 340/542 |
| 5,490,698 A | * | 2/1996 | Dezso | 292/138 |
| 5,539,378 A | * | 7/1996 | Chang | 340/542 |
| 5,686,890 A | * | 11/1997 | Ko | 340/545.1 |
| 5,754,107 A | * | 5/1998 | Ferrantelli | 340/542 |
| 6,035,676 A | * | 3/2000 | Hudspeth | 70/278.1 |
| 6,154,130 A | | 11/2000 | Mondejar | 340/521 |
| 6,225,903 B1 | * | 5/2001 | Soloway et al. | 340/542 |
| 6,388,559 B1 | | 5/2002 | Cohen | 340/5.71 |
| 6,454,324 B1 | * | 9/2002 | Lewis et al. | 292/341.16 |
| 6,950,033 B1 | * | 9/2005 | Guyre | 340/687 |

* cited by examiner

*Primary Examiner*—Davetta W. Goins
(74) *Attorney, Agent, or Firm*—Goldstein Law Office P.C

(57) ABSTRACT

An electronic security system that would alert a homeowner that someone is attempting to gain access to their home. The system includes a transmitter positionable within a dead bolt housing within a doorjamb of an existing door assembly. The transmitter is engaged when a dead bolt is positioned within the dead bolt housing in a locked orientation. The transmitter emits a signal once the dead bolt is removed from the dead bolt housing. A receiver is in communication with the transmitter. The receiver has an internal alarm enunciator. The receiver receives the signal from the transmitter thereby activating the internal alarm enunciator upon removal of the dead bolt from within the dead bolt housing.

2 Claims, 2 Drawing Sheets

ELECTRONIC SECURITY SYSTEM

BACKGROUND OF THE INVENTION

The invention relates to an electronic security system that would alert a homeowner that someone is attempting to gain access to their home.

During the past few decades, crime in America, in all categories, has increased at an alarming rate. Psychologists, sociologists, behaviorists, all have advanced theories as to why this dramatic change in the psyche of generations growing up during this period has become so increasingly violent. Unfortunately, the many theories advanced remain just that, theories, and an effective solution to this problem has not yet been defined. As a result of the seemingly endless increase in crime, businesses and homeowners are installing more and more security systems. There are many different types of security products and alarms systems available, ranging in price from a few hundred dollars to several thousand dollars. Most security systems use either infrared sensors or motion sensors—or a combination—to detect intruders when the security system is activated. No security system is completely foolproof and experienced burglars have learned how to disable or avoid detection by security systems. Individuals occasionally forget to activated a security system which negates the use of the system and makes a home or business vulnerable to illegal entry and burglary. What is needed is a system that would be activated coincident with locking an entrance door, to ensure that the security system is activated.

The present invention attempts to solve the abovementioned problem by providing an electronic security system that would alert a homeowner that someone is attempting to gain access to their home.

U.S. Pat. No. 6,154,130 to Mondejar discloses a remote controlled security system hung from a door knob, and comprised of various sensors for signaling an alarm. U.S. Pat. No. 4,804,945 to Millet discloses a door alarm comprised of an infrared sensor for detecting the touch of the door knob by an individual. U.S. Pat. No. 3,890,608 to Peterson discloses a security system for remotely monitoring and controlling the operation of a door. U.S. Pat. No. 6,388,559 to Cohen discloses a remote control device capable of indicating the status of a door.

While these units may be suitable for the particular purpose employed, or for general use, they would not be as suitable for the purposes of the present invention as disclosed hereafter.

SUMMARY OF THE INVENTION

It is an object of the invention to produce an electronic security system that would alert a homeowner that someone is attempting to gain access to their home.

The present invention is essentially comprised of a transmitter positionable within a dead bolt housing within a doorjamb of an existing door assembly. The transmitter is engaged when a dead bolt is positioned within the dead bolt housing in a locked orientation. The transmitter emits a signal once the dead bolt is removed from the dead bolt housing. The transmitter includes an activation switch in communication therewith. The activation switch is positionable adjacent to the existing door assembly. A receiver is in communication with the transmitter. The receiver has an internal alarm annunciator with a corresponding on/off switch. The receiver receives the signal from the transmitter thereby activating the internal alarm annunciator upon removal of the dead bolt from within the dead bolt housing.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
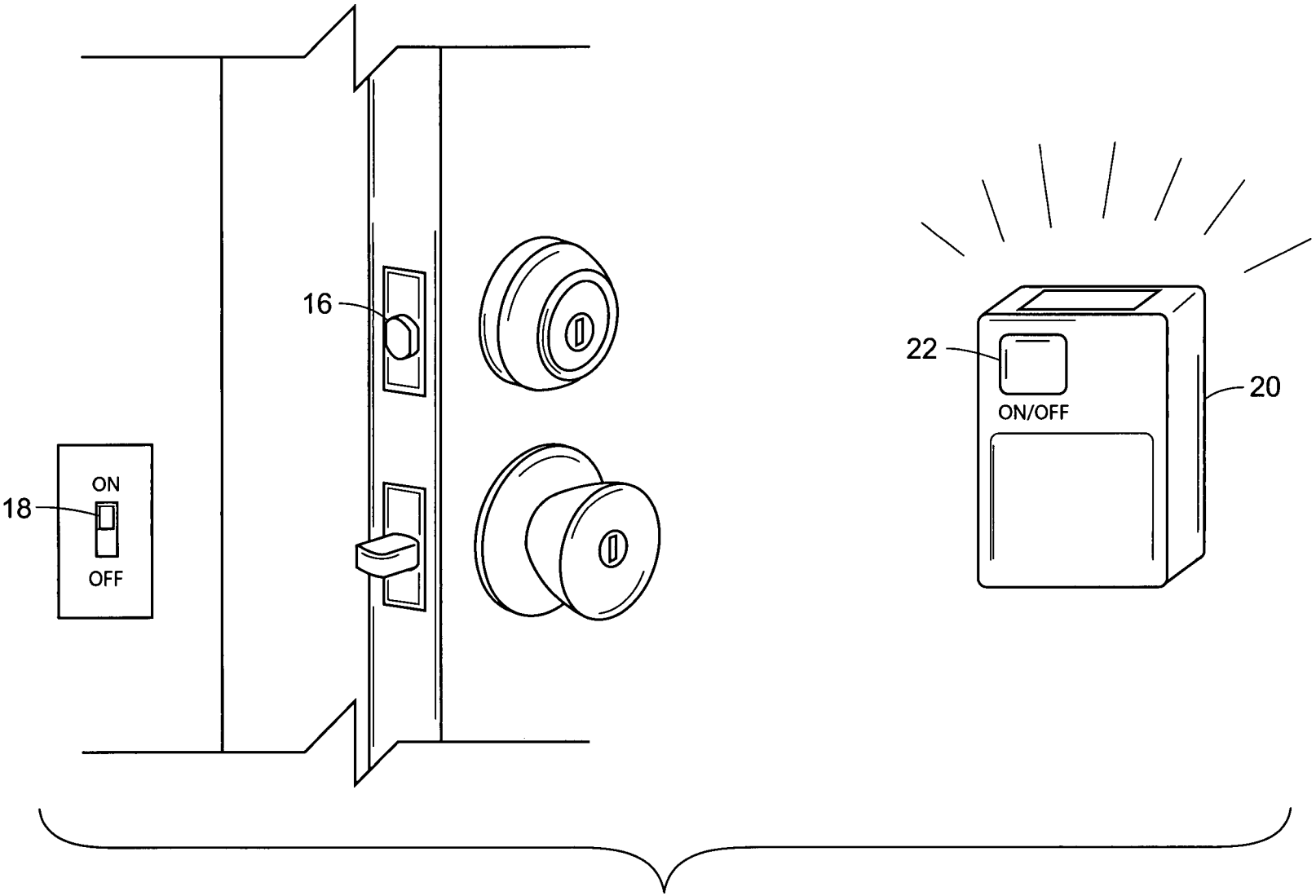
FIG. 1 is a perspective view of the present invention.
Figure 2:
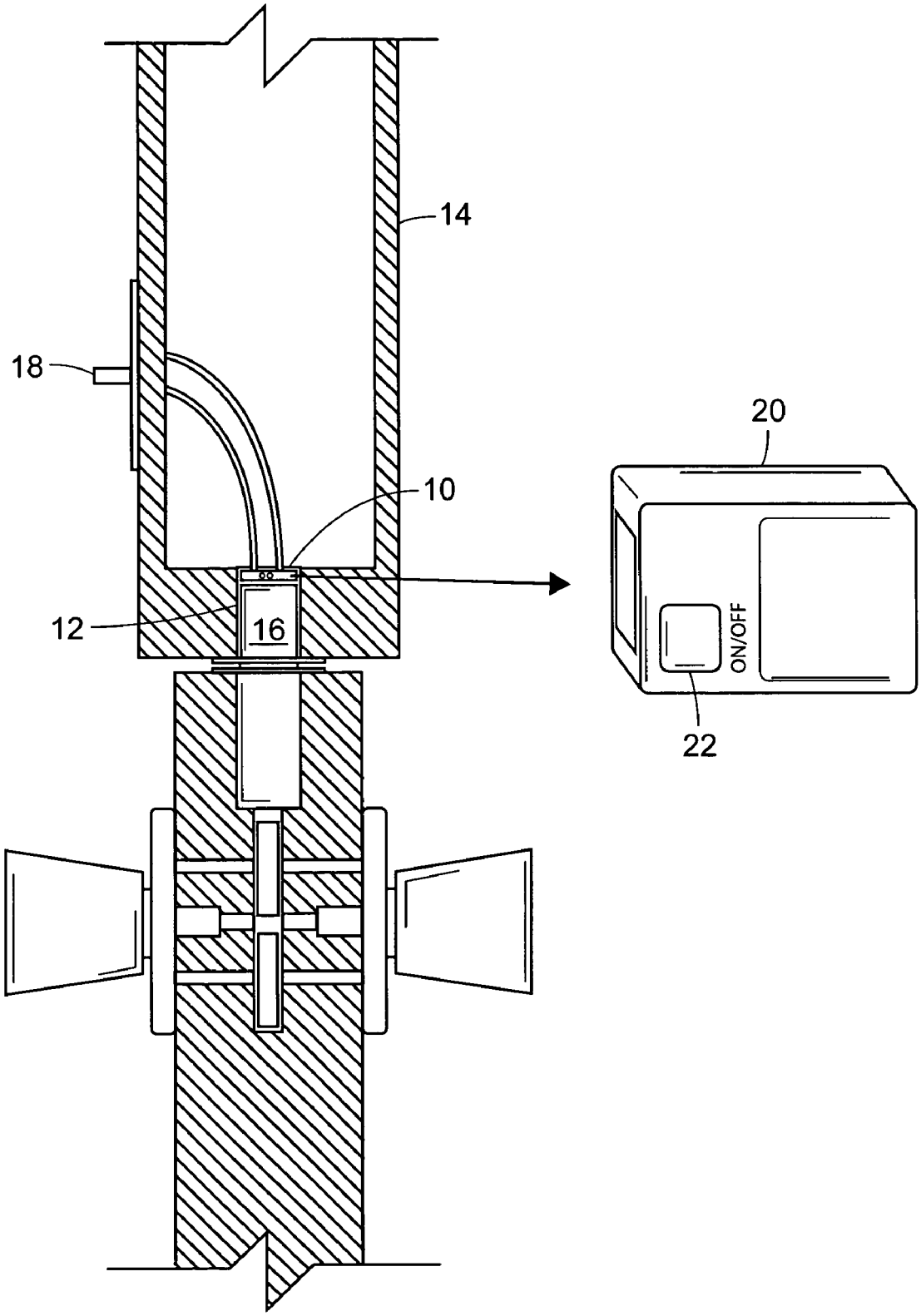
FIG. 2 is a cross-sectional plan view of the present invention.

FIGS. 1 and 2 illustrate an electronic security system that would alert a homeowner that someone is attempting to gain access to their home. In its broadest context, the present invention includes a transmitter and a receiver.

In FIG. 2, the transmitter 10 is positionable within a dead bolt housing 12 within a door jamb 14 of an existing door assembly. The transmitter 10 is engaged when a dead bolt 16 is positioned within the dead bolt housing 12 in a locked orientation. The transmitter 10 emits a signal once the dead bolt 16 is removed from the dead bolt housing 12. The signal would be a 20 kilohertz, radio frequency type signal. In FIG. 1, the transmitter 10 includes an activation switch 18 in communication therewith. The activation switch 18 is positionable adjacent to the existing door assembly 14. In the preferred embodiment, the activation switch 18 resembles a standard wall switch.

The receiver 20 is in communication with the transmitter 10. The receiver 20 has an internal alarm annunciator with a corresponding on/off switch 22. The receiver 20 receives the signal from the transmitter 10 thereby activating the internal alarm annunciator upon removal of the dead bolt 16 from within the dead bolt housing 12. The internal alarm annunciator would receive 20 kilohertz, radio frequency signal transmitted by the transmitter 10 and create a very audible beep, which would alert the wearer that the dead bolt 16 was being moved. Alternately, other types of audible or vibratory alarms could be emitted.

In conclusion, herein is presented an electronic security system that would alert a homeowner that someone is attempting to gain access to their home. The invention is illustrated by example in the drawing figures, and throughout the written description. It should be understood that numerous variations are possible, while adhering to the inventive concept. Such variations are contemplated as being a part of the present invention.

What is claimed is:

1. An electronic security system that would alert a homeowner that someone is attempting to gain access to their home comprising, in combination:

a transmitter positionable within a dead bolt housing within a door jamb of an existing door assembly, the transmitter being engaged when a dead bolt is positioned within the dead bolt housing in a locked orientation, the transmitter emitting a signal once the dead bolt is removed from the dead bolt housing, the transmitter including an activation switch in communication therewith, the activation switch being positionable adjacent to the existing door assembly; and a receiver in communication with the transmitter, the receiver having an internal alarm annunciator with a corresponding on/off switch, the receiver receiving the signal from the transmitter thereby activating the internal alarm annunciator upon removal of the dead bolt from within the dead bolt housing.

2. An electronic security system that would alert a homeowner that someone is attempting to gain access to their home comprising, in combination:

a transmitter positionable within a dead bolt housing within a door jamb of an existing door assembly, the transmitter includes an activation switch positionable adjacnet to the existing door assembly, the transmitter being engaged when a dead bolt is positioned within the dead bolt housing in a locked orientation, the transmitter emitting a signal once the dead bolt is removed from the dead bolt housing; and a receiver in communication with the transmitter, the receiver having an internal alarm enunciator, the receiver receiving the signal from the transmitter thereby activating the internal alarm enunciator upon removal of the dead bolt from within the dead bolt housing.

* * * * *